United States Patent [19]

Füllemann et al.

[11] Patent Number: 4,957,427

[45] Date of Patent: Sep. 18, 1990

[54] LIQUID FUEL PURIFYING BURNER

[75] Inventors: Jörg Füllemann, Mastrils; Heinrich Boner, Malans, both of Switzerland

[73] Assignee: VTH AG Verfahrenstechnik Fur Heizung, Liechtenstein

[21] Appl. No.: 167,300

[22] Filed: Mar. 11, 1988

[30] Foreign Application Priority Data

Mar. 13, 1987 [CH] Switzerland ..... 958/87

[51] Int. Cl.[5] ..... F23Q 3/00

[52] U.S. Cl. ..... 431/265; 431/116; 431/168; 431/353

[58] Field of Search ..... 431/89, 115, 116, 168, 431/169, 208, 210, 265, 353, 354, 242; 239/214, 214.25, 215, 410, 411

[56] References Cited

U.S. PATENT DOCUMENTS

| | | | |
|---|---|---|---|
| 1,936,271 | 11/1933 | Schroeder et al. | 431/168 |
| 2,200,278 | 5/1940 | Johnston | 431/116 |
| 2,535,316 | 12/1950 | Ohlsson | 431/332 |
| 3,021,892 | 2/1962 | Brola | 531/116 |
| 3,175,600 | 3/1965 | Powell | 431/168 |
| 3,640,673 | 2/1972 | Okamoto et al. | 431/165 |
| 4,022,567 | 5/1977 | Miyahara | 431/168 |
| 4,421,475 | 12/1983 | Frick | 431/115 |
| 4,712,997 | 12/1987 | Fullemann et al. | 431/89 |

FOREIGN PATENT DOCUMENTS

| | | | |
|---|---|---|---|
| 0067271 | 12/1982 | European Pat. Off. . | |
| 0166329 | 1/1986 | European Pat. Off. . | |
| 1218100 | 6/1966 | Fed. Rep. of Germany . | |
| 3346431 | 7/1985 | Fed. Rep. of Germany . | |
| 2269029 | 11/1975 | France . | |
| 2332492 | 6/1977 | France . | |
| 549026 | 1/1979 | Japan | 431/116 |
| 187974 | 12/1936 | Switzerland . | |
| 628724 | 3/1982 | Switzerland . | |

*Primary Examiner*—Noah P. Kamen

[57] ABSTRACT

The burner has a motor, a fuel pump and a fan. An easily replaceable component unit (27), the drive shaft (33) of which is coupled to the burner motor, is surrounded by the flame tube (21). The component unit (27) has a drive shaft (33), supported in an adaptor sleeve (37), for driving the gasifier (17). When the burner is started up, the rotatable gasifier (17) is heated by the heater (39). Once the gasifier has reached a predetermined temperature, the supply of fuel takes place through the line segment (19') and through the nozzle (71) to the immediate vicinity of the inner wall of the gasifier (17). Because of the rapid rotation, the fuel is distributed over the entire inner wall of the gasifier (17) and evaporates. Particularly in the mixing head (29), the evaporated fuel mixes with the combustion air flowing in through the opening (77) and is directed radially to the outside by a deflector (31, 31'). Shortly after leaving the mixing head (29), the flame touches the short flame tube (21) and emerges from it. After a short travel in the flame tube, the flame can expand and decompress. As a result, a high flame temperature is avoided, and the formation of nitrogen oxides is diminished. A portion of the combustion gases is recirculated through the recirculation opening (79) and serves to heat the gasifier (17) after the shutoff of the electric heater (39).

42 Claims, 5 Drawing Sheets

17
57
59
31
61
29
30
55
41
21
65
69
63
56
71
41'
39
67
77
73
79
75
51
45
49
53
35
43
19'
27
37
47
33

LIQUID FUEL PURIFYING BURNER

The invention relates to a burner having a hollow gasifier rotating at high speed, a drive unit for rotating the gasifier and means for supplying fuel.

BACKGROUND:

A distinction is made between atomizing burners and gasification burners. In atomizing burners, the fuel is atomized with a nozzle and combusted in a combustion chamber into which air is supplied. Since the atomizing output of the nozzle can be varied only within narrow limits, atomizing burners have the disadvantage that their output cannot be continuously controlled. Nor can they be built for very small heat requirements. The smallest nozzles are dimensioned for an oil throughput of approximately 1.4 kilograms per hour. Because the output of atomizing burners cannot be varied continuously, atomizing burners are operated intermittently whenever the heat requirement is low. Since the intervals between periods of operation cannot be made arbitrarily brief, relatively large boilers are required as energy storage means. Intermittent operation has the disadvantage that switching the burner on and off repeatedly causes severe alternating temperature stresses on the materials, as well as a high burden of soot and toxic substances for the boiler, chimney and environment. Incomplete combustion and soot formation, which occur particularly in the startup phase, are highly detrimental to the overall efficiency of a heating system. Radiation losses in the large boilers contribute further to reducing overall efficiency.

In contrast to the atomizing burners described above, gasification burners as a rule have the advantage that they can be controlled continuously, down to very low outputs, in accordance with the heat requirement. In the combustion of gasified fuel, the emission of toxic substances, such as uncombusted hydrocarbons and soot, is also reduced considerably.

Despite the many advantages of gasification burners, they are used only to a limited extent. One major reason for this is that most gasification burners require a great deal of maintenance. In gasification burners, undesirable deposits generally tend to form in the gasification chamber, which soon impair gasification efficiency and hence burner operation considerably.

In U.S. Pat. No. 4,421,475, to which European Pat. No. 0 036 128 corresponds, a gasification burner having an electrically heatable gasification chamber is described. The temperature of this gasification chamber is measured by a temperature sensor and kept at an optimal value by means of a control device, to prevent fuel carbonization. A further provision for avoiding carbonization is that the gasification chamber has no air inlet openings. Furthermore, a rotatable cleaning device in the form of a wiper is housed in the gasification chamber. This wiper serves to distribute the fuel finely over the heated gasifier walls and prevent deposits from forming, so as to avoid the detrimental influence of deposits on fuel evaporation. The gas formed in the gasification chamber leaves the chamber at relatively high speed through a nozzle. The air required for combustion is provided by a fan. The burner described has the disadvantage of requiring a relatively large amount of electrical energy for evaporation of the fuel. Burners of this type are also relatively expensive, because they require a temperature sensor and a temperature controller. Compared with other gasification burners, where the mixing of fuel and air takes place prior to combustion in the combustion chamber, the combustion of the gas emerging from a nozzle at relatively high speed has the disadvantage of generating a relatively large amount of noise. Cold starting problems can also arise, because the air is not heated, or is heated only insignificantly, prior to the combustion. Another disadvantage is that upon shutoff, gasified fuel can continue to burn with a sooty flame. It is also possible for still-uncombusted hydrocarbons to emerge from the gasification chamber after the shutoff.

European Pat. No. 0 067 271, Noack discloses a continuously controllable oil burner with an electrically heated evaporation device having air inlets, which is monitored by a thermostat. This evaporation device is in the form of a beaker, with air inlets provided on the bottom of the beaker. A rotating cylinder for oil distribution is located in this beaker. This cylinder fills the entire evaporation chamber in the beaker except for a small gap. For oil distribution, oil is supplied to the rotating cylinder via a hollow drive shaft, and then ejected by centrifugal force from the radial bores in the rotating cylinder onto the inner walls of the evaporation chamber. Oil burners of this type have not attained commercial application, however. A disadvantage is that the gasification chamber tends to become soiled, which impairs the entry of air or the exit of the air and gas mixture. Since the pressure difference between the air inlet and the air and gas mixture outlet is very small, even slight soiling results in a sooty flame. Another disadvantage is that the rotating cylinder absorbs a large quantity of heat via the cylinder surface and transmits it via the drive shaft to the drive motor, which can be damaged thereby, unless expensive provisions for protecting it are made. The necessity for thermostat monitoring of the gasifier contributes further to increasing the initial cost of the burner.

U.S. Pat. No. 3,640,673 describes a burner for a kerosene stove in which a fan is located in the gasification chamber, which is heatable electrically and by the flame of the burner. A relatively large space exists between the periphery of the fan and the heated wall surface of the gasification chamber. An atomizer plate for the fuel is located on the drive shaft for the fan. When fuel is sprayed onto the atomizer plate during operation, the plate distributes the fuel into fine droplets, which are spun outward by centrifugal force. In this process they are mixed by the fan with the preheated air flowing into the gasification chamber. Since the distance between the periphery of the fan and the heated wall face of the gasification chamber is relatively large, most of the fuel droplets evaporate without ever coming into contact with the wall surface. The few fuel droplets that do strike the heated wall of the gasification chamber then evaporate there. It is disadvantageous that deposits form on the wall, which impair the evaporation, especially in the startup phase, when the gasification chamber is heated only electrically. This can then cause startup problems. Furthermore, uncombusted hydrocarbons occur both in the startup phase and in the shutoff phase. A further disadvantage of the described burner is that it can be operated only with Kerosene, is practically an atmospheric burner, and thus is unsuitable for use with a boiler.

European Patent Application No. 0 166 329 of Fullemann, which was published on Jan. 2, 1986, describes a gasification burner in which a rotor, provided with blades that extend to the vicinity of the heatable wall of the gasification chamber, is provided. The gasification chamber has an air inlet. The fuel supplied via the rotor shaft is finely distributed by the rotor and mixed with compressed air, evaporating in the hot gasification chamber. The mixture can escape at relatively high pressure through openings in a burner plate and burns with a low-noise, blue flame.

For the sake of completeness, the oil burner described in Swiss Pat. No. 628 724 should also be noted, which although it is an atomizing burner also shares some characteristics of a gasification burner. It has the intrinsic disadvantage of atomizing burners of not being controllable over a wide output range. Even in the lowest output range, it still requires a relatively high throughput of 1.6 to 2.1 kilograms of oil per hour.

For gasification of the atomized oil droplets, a mixing tube and a flame tube are provided coaxially with the nozzle. In operation, the oil is injected through the nozzle into the mixing tube, into which the air required for combustion is also blown. A flame then forms at the end of the mixing tube. A portion of the hot combustion gases is then recirculated to the beginning of the mixing tube and mixed there with the mixture of atomized oil and air for the sake of heat exchange. Because of the recirculation of a portion of the combustion gases, this burner enables extensive gasification of the oil droplets in the mixing tube and thus better combustion with less soot. However, this advantage is attained at the cost of an increased formation of nitrogen oxides ($NO_x$). The burner in fact requires a long flame tube. Since expansion of the flame takes place only after it emerges from the flame tube, there is a relatively large flame zone at very high temperatures, which favors the formation of nitrogen oxides. As already mentioned, the burner also has the disadvantage of not being controllable over a wide output range. In the lowest output range, it requires a relatively high oil throughput of 1.6 liters per hour. This burner has additional problems in startup and shutoff, a factor that is all the more serious since the burner has to be operated intermittently. One problem in startup is the ignition of the oil droplets flowing out of the atomizer nozzle. Unlike a conventional atomizing burner, optimal disposition of the ignition electrodes is prevented in this case by a wall having an air aperture plate. Hence there is a great danger that ignition will not occur even in repeated starting attempts. A further problem is that at startup, the mixing tube is cold and thus has no evaporation capacity. The flame is therefore extremely sooty until the mixing tube has attained a high temperature and is capable of evaporating the oil that strikes it. When the burner is shutoff, the oil dripping from the nozzle continues to burn with an extremely sooty flame. Since at shutoff the mixing tube located near the nozzle is still red-hot, a great deal of heat radiates from toward the nozzle, which can lead to carbonization of fuel in the nozzle. This can clog the nozzle, especially when it is small.

German Patent Disclosure 3 346 431 discloses a burner having a rotating evaporator cup. This cup is closed on the flame side and has an outlet for the evaporated fuel only on the motor side. The evaporator cup is surrounded by an annular deflection chamber for the air supply. Gasified fuel and air then flow between the evaporator cup and the flame tube in two concentric flows of annular cross section, strike a baffle ring, mix, and then form a flame. The disadvantage is that the evaporator chamber is not subjected to a forceful flow of hot gases, and so deposits form there that soon impair the function of the burner. In particular, a major emission of uncombusted hydrocarbons occurs upon shutoff of the burner French Pat. No. 2 269 029 also discloses a burner having a rotating evaporator cup that is closed on the flame side. The evaporator cup is lined on the inside with a wire mesh, which serves to prevent an outflow of the fuel. This burner needs a strong blower that requires a relatively large amount of energy, because the fresh air and the air and gas mixture are deflected several times. Another disadvantage is that after shutoff of the burner, a large amount of fuel is still evaporating from the wire mesh, which was previously swept with air and therefore has remained relatively cool; once again, a major emission of hydrocarbons is the result.

U.S. Pat. No. 2,535,316 discloses a burner having a spherical gasification chamber, which rotates slowly. The fuel flowing through a line forms an oil bath at the bottom of the chamber, from which the lighter fractions evaporate. The remaining tar and coke residue forms a thin layer on the chamber wall, and with the slow rotation of the chamber, this layer migrates slowly upward. There, a flow of air meets this layer and burns it off continuously. The disadvantage here is that when the burner is shut off the oil bath causes a major emission of soot, tar and uncombusted hydrocarbons.

THE INVENTION

It is an object to provide a burner that at least partially, and preferably largely, overcomes the aforementioned disadvantages of the known burners. It is intended to enable operation at low outputs and/or to enable adaptation of the output to the heating requirement, as well as to be operationally dependable and require little maintenance. It should also meet stringent environmental protection regulations, for example assuring clean combustion while in operation, with low nitrogen oxide emissions, and emitting no uncombusted hydrocarbons upon startup and shutoff.

Briefly, according to the invention, the gasifier rotates at high speed, has an inlet for air and an outlet for a gas/air mixture, and means are provided for recirculating hot combustion gases to the inlet.

In accordance with a feature of the invention, the gasifier rotates at high speed, so that no atomizing nozzle is needed for distributing the fuel over the inner wall of the gasifier. The disadvantages of burners having atomizing nozzles are thus avoided. Instead of atomizing the fuel, the fuel may be aimed in the form of a stream, for example, at the inner wall of the gasifier. The fuel then continues to adhere to the inner wall, but centrifugal force presses it firmly against the inner wall, thereby distributing it in a thin film over the entire inner wall and promoting gasification of the fuel.

In continuous operation, the heat required for gasification is furnished by the recirculation of hot combustion gases. Such hot combustion gases flow backward from the flame, past the outer wall of the gasifier, and are forced into the inlet of the gasifier. Because of the high temperature in the gasifier and the rapid throughput of air and combustion gases, a continuous cleaning takes place. Satisfactory combustion of even relatively poor grades of oil thus becomes possible. It is also important that the output of the burner can be readily controlled at a ratio of approximately 1:3.

DRAWING

Exemplary embodiments of the invention will now be described, referring to the drawing.

DETAILED DESCRIPTION

Figure 1:
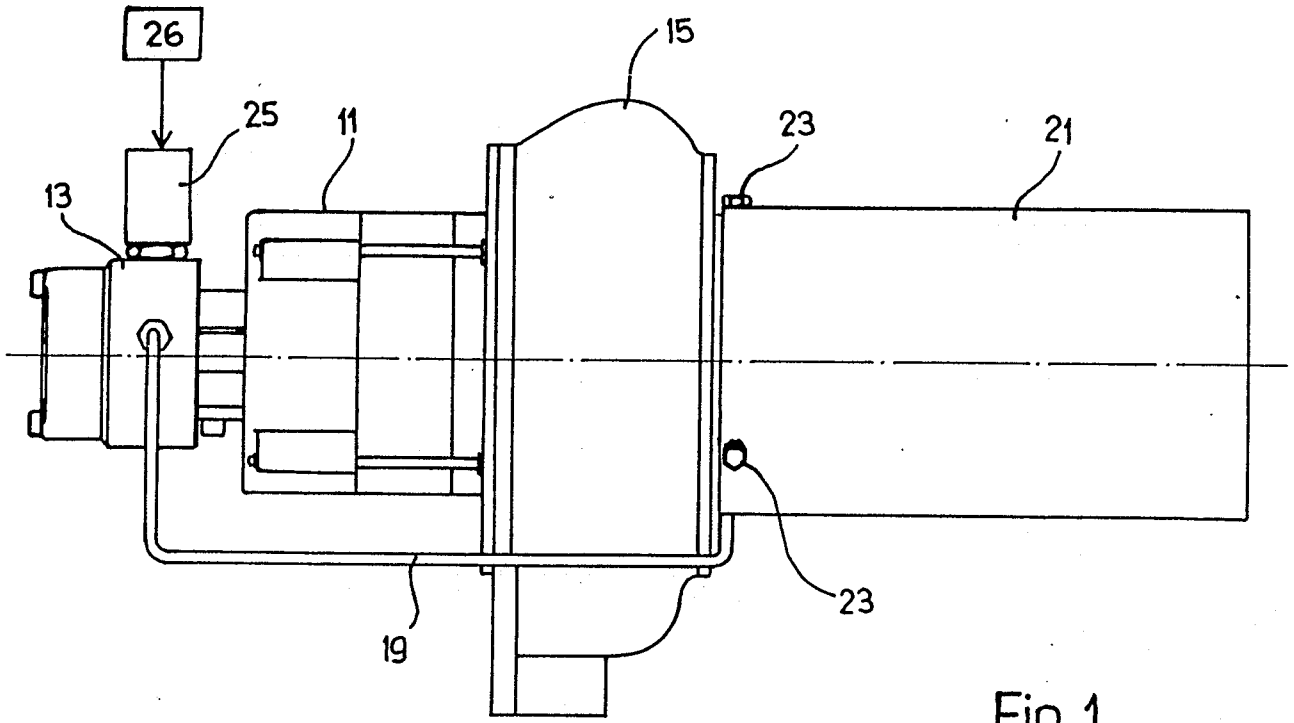
FIG. 1 is a view of a burner according to the invention.

The burner shown in FIG. 1 has a motor 11, which is used to drive the fuel pump 13, the fan 15 and the rotatable gasifier 17. (see FIGS. 2 and 3). From the fuel pump 13, a fuel line 19 (FIG. 1) leads to the gasifier 17 (FIG. 2), which is surrounded by a flame tube 21. The flame tube 21 can be removed easily by loosening the screws 23. A volustat, or fuel volume supply unit, e.g. a magnetic valve or another suitable device 25 is used to control the fuel supply in accordance with control commands of the heating control system 26.

A volustat is an apparatus that, in accordance with an input signal, furnishes a corresponding feed volume per unit of time, this volume being virtually unaffected by resistance in the feed line. The feed volume is also virtually unaffected by the viscosity of the fuel. Volustats are made by the Satronic company in Regensdorf, Switzerland, for example.

Figures 2, 3:
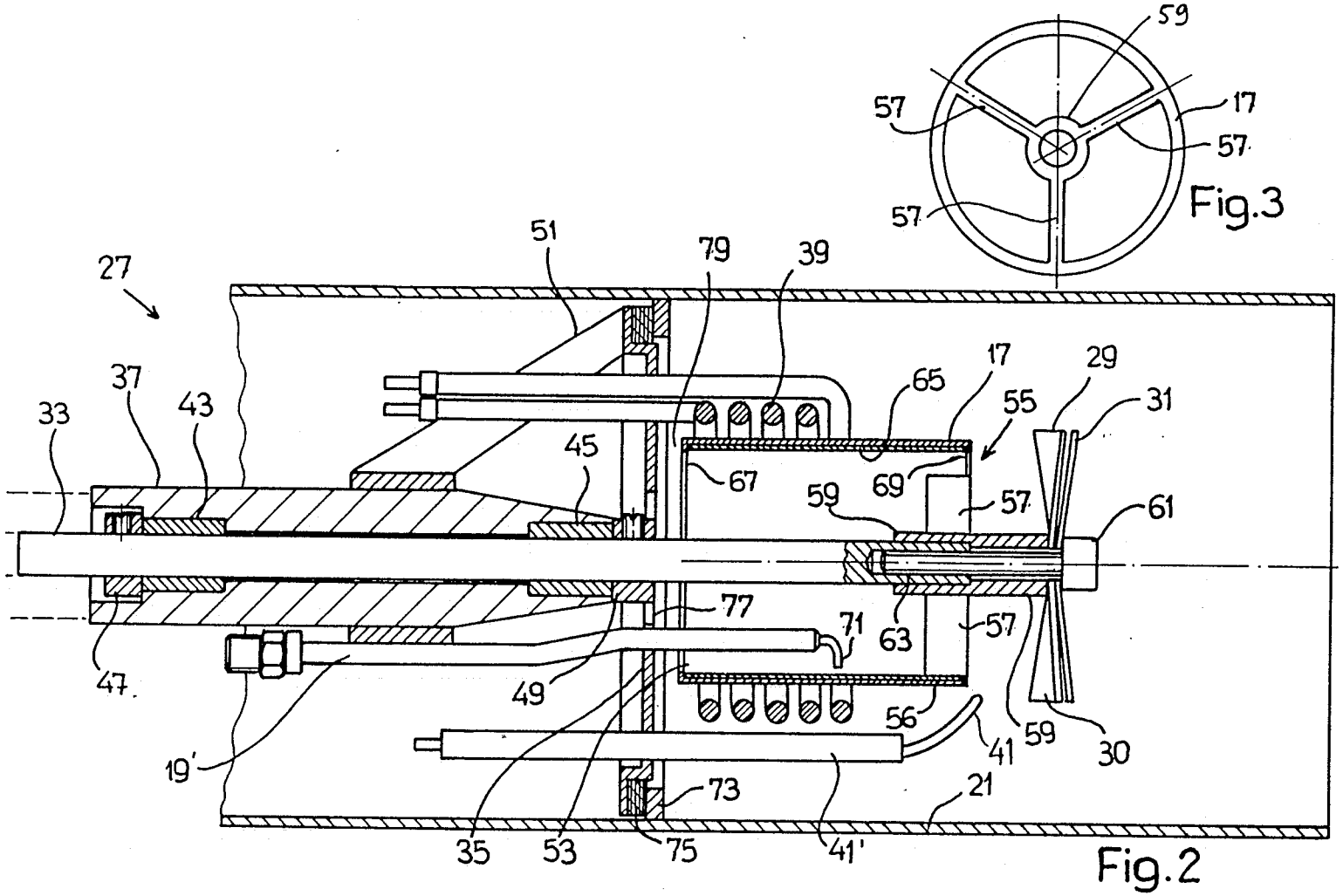
FIG. 2 is a sectional view through a first exemplary embodiment of the burner.
FIG. 3 is a side view of the gasifier of FIG. 2, seen from the right.

FIG. 2 shows an easily replaceable component unit 27, which substantially comprises the rotatable gasifier 17, the mixing head 29, the baffle plate 31 forming a deflector, the drive shaft 33 for the gasifier 17, the air aperture plate 35, the adaptor sleeve 37, the fuel line segment 19', the electric heater 39 and the ignition electrode 41. After assembly, the component unit 29 is surrounded by the flame tube 21. The flame tube is relatively short and protrudes only a short distance beyond the mixing head 29.

The mixing head 29 comprises a fan wheel having radial blades 30. Other embodiments of the mixing head 29 will be described below in conjunction with FIGS. 4 and 6.

The drive shaft 33 is supported in the adaptor sleeve 37 by two bearings 43, 45, for example sintered bearings. The axial position of the drive shaft 33 is fixed for example by the setting rings 47, 49. The air aperture plate 35 is secured on the adaptor sleeve 37 by the support 51.

The gasifier 17 is formed as a hollow rotational body and has an inlet 53 and an outlet 55. In the exemplary embodiment shown, the gasifier takes the form of a cylindrical tube segment 56 and has connectors at the outlet in the form of spokes 57, which lead radially inward from the tube segment 56 to a hub 59. Accordingly, the gasifier substantially comprises the tube segment 56, the spokes 57 and the hub 59, which is used for securing it to the drive shaft 33. The gasifier 17 is secured, along with the mixing head 29 and the baffle plate 31, by the screw 61, which is screwed into the axial threaded bore 63 of the shaft 33.

It has proved to be advantageous to provide means 65 that increase the effective surface area of the gasifier 17 above the surface area of the gasifier defined by a theoretical envelope of the gasifier 17. These surface increasing means may for example comprise an insert 65 made from a metal cloth. By means of a metal cloth of this kind, capillary action is brought about, which finely distributes the fuel. However, it would also be possible to provide a high number of fine grooves on the inner wall of the gasifier 17, as the means for increasing the surface area. These grooves should extend in the axial direction or helically, to assure good distribution of the fuel by centrifugal force. An ignition electrode 41' having a tip 41 is located near outlet 55. The tip 41 is set back from outlet 55 (see FIG. 1).

A radially inwardly oriented extension 67, 69 is advantageously provided on each end of the tube segment 56, that is, at the inlet 53 and outlet 55. This prevents the escape of liquid fuel because of the operative centrifugal force. The extension 67 also serves as a retaining means for the metal cloth insert 65.

Since the spokes 57 are located at the outlet, the fuel line segment 19' can extend through the inlet 53 into the interior of the gasifier 17. A nozzle 71 aimed at the gasifier wall and extending to near the insert 65 is located at the end of the fuel line segment 19' so that exiting fuel immediately makes contact with the metal cloth.

An extension ring 73, which presses against a sealing ring 75 at the air aperture plate 35, is located on the flame tube 21. This assures that the air required for combustion can flow only through a central opening 77 in the air aperture plate 35. Opening 77 is smaller than the diameter of gasifier 17 (see FIG. 2). Spaced from the opening 77, there is a recirculation inlet 79 for the gasifier 17. This recirculation inlet 79 is formed by locating the air aperture plate 35 at a distance from the gasifier 17. The result is a gap 79 between the air aperture plate 35 and the gasifier 17, which forms the recirculation inlet.

Burner operation:

Upon starting, the electric heater 39 is first switched on by the heating control 26 for approximately two minutes. During this time, the gasifier 17 along with the insert 65 is heated to approximately 550° C. by radiation from the heating coils. After a preheating time, the burner motor 11 is started, which drives the pump 13 and the fan 15 for supplying the air required for combustion, and the gasifier 17 is rotated. The oil pumped by the pump 13 flows through the fuel line 19, 19' to the nozzle 71 and moistens the metal cloth insert 65. By the capillary action of the metal cloth and by centrifugal force, the fuel is distributed over the entire insert 65 and, because of the high temperature, evaporates. The evaporating fuel is mixed with the air flowing in through the opening 77 and is ignited at the outlet 55 by the ignition electrode 41. In the annular gap between the outlet 55 of the gasifier and the baffle plate 31, a blue flame is produced, which extends far beyond the end of the flame tube 21. A portion of the hot combustion gases produced by the flame flows backward.. from the outlet 55 between the gasifier 17 and the flame tube 21 to the recirculation inlet 79, thus providing for heating of the gasifier 17. The electric heater 39 can then be switched off. The recirculated hot gases then flow from the inlet 53 back to the outlet 35 and mix with gasified fuel, on the one hand, and with incoming fresh air, on the other. Since the fresh air flows into the center of the inlet, it does not cause excessive cooling of the gasifier, which could impair gasification. The mixing head 29 disposed at the outlet 55 effects good mixing of air, recirculated gases and evaporated fuel, so that optimal combustion takes place. When the burner is shutoff, the supply of fuel through the nozzle 71 ceases immediately. The gasifier 17 continues to rotate, however, for some time, in the course of which air continues to be fed by the fan 15. Until the gasifier 17 comes to a stop, the fuel located in the metal cloth 65 evaporates and still combusts completely. Since the cold parts in the gasifier, that is, the shaft 33, the spokes 57 and the hub 59, are not moistened by fuel, uncombusted hydrocarbons do not emerge from the gasifier after the shutoff of the burner. The same applies for the startup phase.

It should be noted that the mixing head 29 and the baffle or deflection plate 31 cause a deflection of the gas/air mixture emerging from the outlet 55 and thus of the flame, radially toward the inner wall of the flame tube 21. In other words, the flame touches the flame tube 21 shortly after being formed. This has the advantage of allowing the flame tube to be short, which in turn permits the use of the burner in a great number of different boilers. A very important factor is that the flame leaves the flame tube shortly after its formation and can expand. As a result, the flame temperature drops. A lower flame temperature has the important advantage, from the standpoint of environmental protection, that only a small quantity of nitrogen oxides is produced. Despite the short flame tube 21, however, adequate recirculation for heating the gasifier is assured, because the flame is present at the flame tube and thus effects sufficient pressure in the rear portion of the flame tube.

Figure 4:
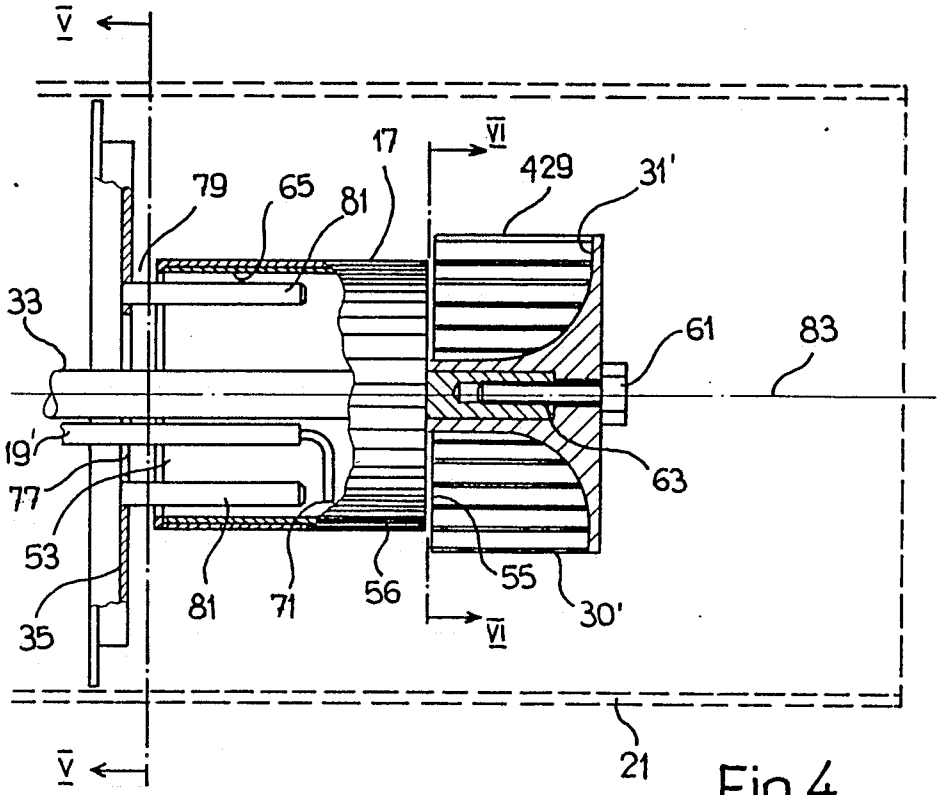
FIG. 4 is a sectional view through a second exemplary embodiment of the burner, but showing primarily only the parts that are formed differently from those in FIG. 2.
Figure 5:
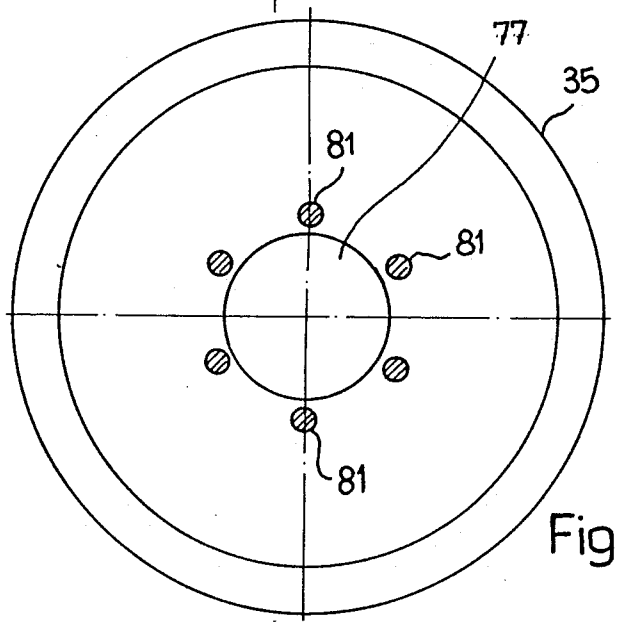
FIG. 5 is a sectional view taken along the line V—V of FIG. 4.
Figure 6:
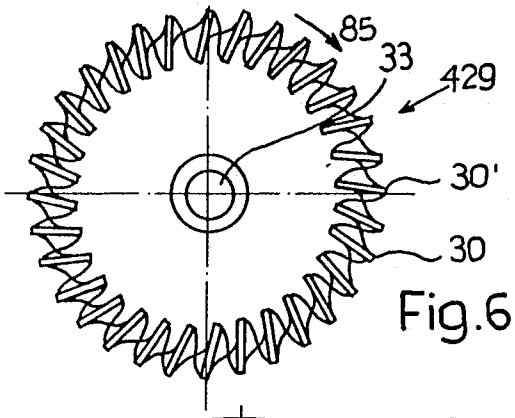
FIG. 6 is a sectional view taken along the line VI—VI of FIG. 4.

The exemplary embodiment of FIGS. 4-6 differs from the exemplary embodiment of FIG. 2 basically only in that the mixing ahead 29 is different and that mixing prongs 81 are provided on the air aperture plate 35. Otherwise, the burner of FIG. 4 is embodied identically to those of FIGS. 1 and 2, so that the description of those figures can be referred to here.

As FIG. 5 shows, the mixing prongs 81 are arranged concentrically about the opening 77 in the air aperture plate 35. These mixing prongs cause turbulence in the gasifier chamber, thus effecting good mixing of the gasified fuel with air.

The mixing head 429 is advantageously in one piece. It has a deflector portion 31', from the periphery of which blades 30' extend toward the gasifier 17. These blades 30' are located at approximately the same distance from the axis of rotation 83 as the periphery of the gasifier 17. As FIG. 6 shows, the blades 30' are located with respect to the rotational direction 85 of the mixing head such that they have the tendency to feed air from the outside inward. In operation of the burner, however, this is not the case, because the air flowing, through the gasifier counteracts this tendency. The blades 30' accomplish a particularly intensive mixing of fuel and air, so that a calm flame is produced at the periphery of the mixing head 429.

Figure 7:
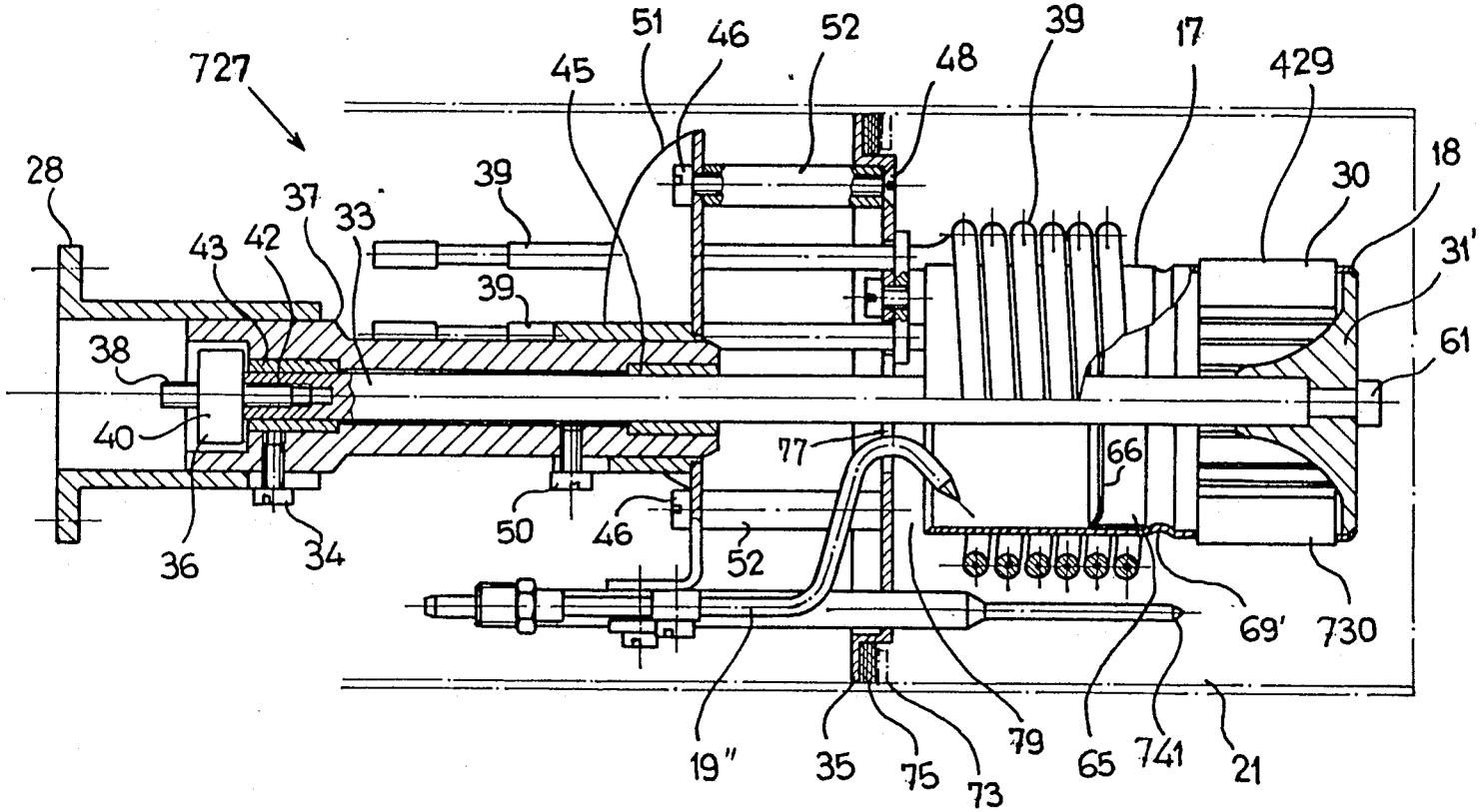
FIG. 7 is a sectional view taken through a preferred third exemplary embodiment of a burner, in which the gasifier and mixing head are in one piece.

The third exemplary embodiment according to FIGS. 7– represents a substantial simplification over the second exemplary embodiment. Otherwise, the burner is identical to those of FIGS. 1 and 2, so that for details, the description of those figures can be referred to. The component unit 727 substantially comprises the gasifier 17, rotating at high speed, having the mixing head 29 or 429 and the deflector portion 31', the drive shaft 33 for the gasifier 17, the air aperture plate 35, the adaptor sleeve 37, the fuel line segment 19'', the electric heater 39 and the ignition electrode tip 741. After assembly, the component unit 27 is surrounded by the flame tube 21. Reference numeral 28 indicates a flange for securing the component unit 27 on the fan 15 (see FIG. 1), which is accomplished by tightening the screw. The drive shaft 33 is supported in the adaptor sleeve 37 by two bearings 43, 45. The bearing 45 is spaced relatively far apart from the gasifier 17, so that it is well protected from heat. To attain this, an axially adjustable support 51, which can be fixed with a screw 50, is provided on the adaptor sleeve 37, having arms or spacer elements 52 for supporting the air aperture plate 35. In operation, the spacing of the air aperture plate 35 apart from the bearing 45 assures that the drive shaft 33 between the bearing 45 and the gasifier 17 is cooled by the fresh air. The spacer elements 52 may for example be connected to the support 51 or the air aperture plate 35 by means of screws 46, 48.

The coupling between the motor 11 and drive shaft 33 is effected via a coupling segment 36, which has a thread 38, a body 40 of elastomeric material and a thread 42. The thread 38 can be screwed into an axial thread in the shaft of the motor 11 (FIG. 1) by rotation at the mixing head 29. The gasifier 17, the mixing head 29 or 429 and the deflector portion 31' form a unit 18, which is secured with screw 61 to the drive shaft 33. This unit can be inexpensively manufactured from a tube segment. It can also be manufactured from a piece of sheet metal, which is then rolled into a tube segment and welded at the abutting end or joined in some other manner. In the portion of the tube segment forming the mixing head 429, the deflector portion 31' is then introduced and welded or otherwise joined to the tube segment. The mixing head 29 is formed by the front portion of the tube segment. The mixing head 429 is separated from the gasifier 17 by a constriction 59'. This constriction corresponds to the extension 69 of FIG. 2 and forms an inwardly oriented barrier, which prevents the liquid fuel from flowing unevaporated into the mixing head.

The mixing head 29 has blades 730. These blades 730 can be formed out from the wall, by initially forming U-shaped slits 32 (see FIG. 8) in the piece of sheet metal or in the wall and then bending over the tabs 30'. The blades 730 protrude inward and advantageously are located in such a way with respect to the rotational direction of the mixing head 29 that they have the tendency of feeding air from the outside inward. In operation, however, the air flowing through the gasifier counteracts this tendency. As a result, the blades 730 effect an intensive mixing of gasified fuel and air, so that a calm flame is produced at the periphery of the mixing head 429.

One advantage of the construction described is that unlike the exemplary embodiment of FIGS. 2 and 3, no additional connecting means, such as spokes, are necessary for connecting the gasifier 17 with the drive shaft 33.

Tests have shown that an insert (65 in FIG. 2) of metal cloth can many times be dispensed with. This is particularly true if the gasifier 17 is relatively long. With a short gasifier 17, it is advantageous to provide a metal cloth insert 65 having an upwardly bent rim 66 (FIG. 7). This rim is formed as a radial flange that protrudes radially into the gasifier chamber and that intercepts any fuel droplets, so that they evaporate.

An extension ring 73 which presses against a sealing ring 75 at the air aperture plate 35 is located on the flame tube 21. This assures that the air required for combustion can flow only through the central opening 77. Because of the spacing apart of the gasifier 17 from the air aperture plate 35, the recirculation inlet 79 is created.

A fireproof steel is suitable and preferred as the material for the unit 18 and the flame tube 21.

Figure 10:
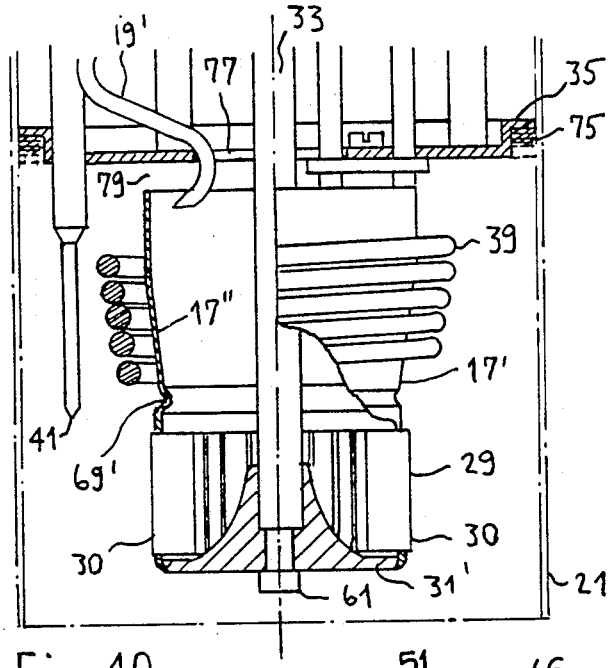
FIG. 10 shows a fourth exemplary embodiment of a burner, in which the gasifier is arranged vertically.
Figure 8:
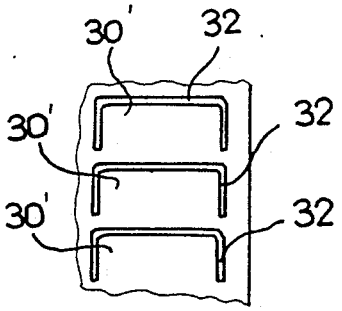
FIG. 8 shows the formation of U-shaped slits in order to embody the blades of the mixing head.
Figure 9:
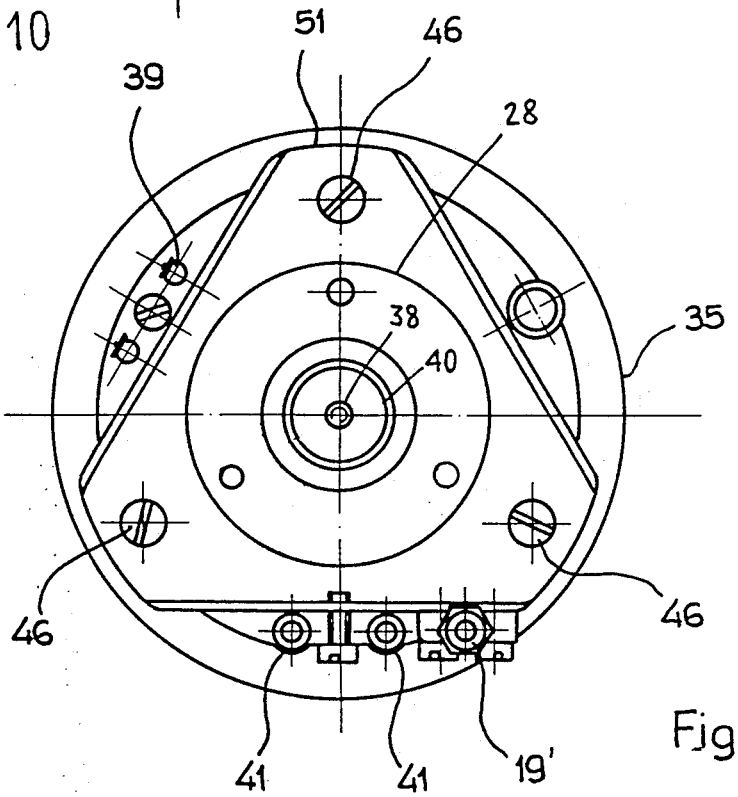
FIG. 9 is a view from the left of the component unit shown in FIG. 7.

The burner according to the fourth exemplary embodiment of FIG. 10 is practically identical to those of FIGS. 7–9, so details can be found in the foregoing description. The burner of FIG. 10, however, is a vertical burner, that is, a burner that is vertically arranged, instead of horizontally. The gasifier 17' has a slightly conical portion 17''. As a result, the centrifugal force in the rotation of the gasifier 17' compensates for the gravity acting upon the fuel, which after emerging from the fuel line 19' might to flow downward on the inner wall of the gasifier 17'. Despite the vertical arrangement of the gasifier 17' the fuel is therefore distributed quite uniformly over the inner wall and evaporated. Other modifications are also possible, without departing from the basic concept of the invention. For instance, the burner could also be arranged vertically with the mixing head oriented upward.

The gasifier advantageously is in the form of a cylindrical tube segment, which substantially facilitates manufacture of the gasifier. For instance, it can be made from cylindrical tube material. The cylindrical embodiment also has the advantage that centrifugal force effects good distribution of the fuel over the entire inner wall. It is therefore sufficient for the fuel supply line to be extended somewhat into the tube segment. The fuel supply line can extend through the inlet of the gasifier into its interior, so that fuel need not be supplied through the drive shaft of the gasifier, which would necessitate a relatively costly type of contruction. If desired, however, the fuel supply can be naturally done through the drive shaft.

A nozzle aimed at the gasifier wall is suitably provided at the end of the fuel supply line, extending to near the inner wall of the gasifier or near the surface of the means that increase the surface area. The nozzle is simply a restriction of the fuel line to a cross section of approximately 1 mm, rather than being a kind of atomizer nozzle such as is used in atomizing burners. To prevent fuel from escaping at the ends of the tube segment, a radially inwardly oriented extension 66 is provided at least at the outlet end of the tube segment.

The rotating gasifier can be driven in various ways. For instance, the gasifier can be rotated by the air flow flowing through it. Advantageously, however, the rotatable gasifier has a drive shaft is coupled to the drive unit, for example the burner motor 11. This assures that when the burner is switched on, the gasifier will rotate. Connecting means, for instance in the form of spokes, are suitably provided, connecting the gasifier to the drive shaft or to a hub mounted on the drive shaft. The spokes are suitably disposed at the outlet. This makes it possible to have a fuel line protrude into the gasifier from the inlet. In that case, practically the entire gasifier wall is available for receiving a metal cloth insert. To enable heating of the gasifier when the burner is switched on, a stationary electric heater 39 is suitably located spaced apart from the rotating gasifier. The gasifier is then heated by radiant heat. A flame tube is then also advantageously disposed coaxially with and spaced apart from the gasifier and from the electric heater.

A gasifier through which air flows has the disadvantage of being severely cooled by the air. If an electric heater had to supply the energy required for gasification continuously, this would consume a considerable amount of electric current. In an exemplary embodiment of the invention, however, a hot gas recirculation inlet 79 is provided for the gasifier. This makes it possible to switch off the electric heater after the startup of the burner, and to draw the gasification heat from the hot gases produced in combustion.

Advantageously, an air aperture plate 35 having an opening for supplying air to the inlet of the gasifier is provided. This air supply opening is suitably located centrally and also serves as a passageway for the drive shaft for the gasifier. The relatively cold air is thereby deflected into the center of the gasifier.

At least one mixing prong 81 protruding into the gasifier is suitably provided. This mixing prong creates turbulence which promotes the mixing of the gasified fuel with air. Suitably, a number of mixing prongs are located concentrically about the opening of the air aperture plate (FIG. 5). This arrangement provides for particularly good mixing of air with gasified fuel. The air aperture plate 35 is suitably located spaced apart from the gasifier, the gap between the air aperture plate and the gasifier forming the hot gas recirculation inlet 79. Because of this arrangement, it is primarily the hot recirculated gases that sweep along the inside wall of the gasifier, while the cold air flows through the gasifier more in the interior region thereof. Good evaporation of the fuel is thereby attained, and continued evaporation of fuel after the shutoff of the burner is avoided.

In an exemplary embodiment of the invention, a mixing head is located at the outlet of the gasifier. This mixing head rotates together with the gasifier and effects good mixing of gasified fuel and air. The mixing head can be embodied in various ways. For instance, it may be formed by means of a fan wheel, located spaced apart from the outlet and having radial blades. A mixing head of this kind can be manufactured using relatively little sheet metal. The tip 41 of the starting electrode is preferably so located that it is exposed to the gasified mixture for ignition while being set back (FIGS. 2, 7, 10) from the region where the flame will project when the burner operates. It is in the path of recirculated gases.

It has proved to be suitable for a preferably slit baffle plate to be spaced apart from the outlet of the gasifier, which promotes recirculation. Slitting of the baffle plate provides that it will be sufficiently well cooled.

An advantageous embodiment provides that the mixing head is formed by a deflector part, spaced apart from the gasifier, having blades extending toward the gasifier. The blades are thus located on the periphery of the mixing head and their pitch is such that they have the tendency to feed air from the outside inward. This is not the case during operation, however, because the air flowing in through the opening of the air aperture plate counteracts this tendency. This embodiment of the mixing head mixes gasified fuel and air particularly well, so that a calm flame is produced at the periphery of the mixing head.

The gasifier advantageously has means that increase its surface area, such as a metal cloth. This increases the effective surface area of the fuel film and accelerates the gasification. If a metal cloth or a porous sintered composition is used, capillary action also becomes operative, which facilitates the distribution of the fuel over the entire gasifier wall. The means for increasing the surface are suitably provided by an insert that lines the inner wall of the hollow body. Such an insert is easy to replace, if necessary, during maintenance work. Since the fuel, upon emerging from the fuel supply line, immediately comes into contact with the metal cloth that increases the surface area, capillary and centrifugal forces immediately become operative there, having the tendency to distribute the fuel over the entire surface of the gasifier interior. Accordingly, there is no danger that fuel droplets will be entrained by the forceful air flow in the gasifier and carried to the outside.

The insert advantageously has a flange that protrudes practically radially inward. As a result, any oil droplets are intercepted and evaporated on the hot surface of the insert.

An advantageous embodiment of the invention provides that the gasifier, the mixing head and the deflector portion form a unit. This unit can then easily be secured with one screw to the drive shaft, which makes maintenance work for the burner easier. Even a person lacking specialized skills is capable of replacing a unit having the gasifier and mixing head in minimum time. That would not be the case, for instance, in replacing a nozzle of a known atomizing burner. The gasifier and mixing head can be made from a single tube segment, for example a piece of sheet metal shaped into a tube segment. This considerably facilitates manufacture and makes it much less expensive. The blades of the mixing head can be formed out from the wall. This can be done by stamping work, for example.

In the described embodiment of the gasifier and mixing head, the blades have a dual function. On the one hand, they serve as means for mixing gasified fuel and air, and on the other hand, they act as connecting bridges between the gasifier and the drive shaft. Separate spokes, such as are required when the gasifier and mixing heads are separate parts, can thus be dispensed with.

The blades suitably protrude inward; this enables forming a relatively calm flame at the mixing head.

The cooling action of the air flowing into the gasifier can be exploited for cooling the drive shaft bearing, by providing a spacing, approximately equivalent to the length of the gasifier, between the gasifier and the bearing.

Various changes and modifications may be made, and features described in connection with any one of the embodiments may be used with any of the others, within the scope of the inventive concept.

We claim:

1. A burner comprising
a rotating gasifier (17), said gasifier including
a hollow body rotating at high speed,
an inlet (53) for air into the hollow body, and
an outlet (55) from the inside of the hollow body for a gas/air mixture;
means (13, 25, 19) for supplying fuel to the interior of the hollow body of the gasifier (17);
a drive means (11) for rotating the gasifier (17); and
means (21) external of the hollow body for the recirculation of hot combustion gases from the outlet (55) to the inlet (53).

2. A burner according to claim 1, wherein the gasifier has the form of a cylindrical tube segment (56).

3. A burner according to claim 2, wherein an annular, radially inwardly oriented extension (67, 69) is provided at least on the outlet end of the tube segment (56).

4. A burner according to claim 1, wherein the fuel supply line (19') extends through the inlet (53) of the gasifier (17) into the interior of the gasifier.

5. A burner according to claim 4, including a nozzle (71) aimed at the gasifier wall, located at the end of the fuel supply line (19') and extending close to an inner wall of the gasifier (17).

6. A burner according to claim 1, wherein the rotatable gasifier (17) has a drive shaft (33) coupled to the drive means (11).

7. A burner according to claim 6, wherein the drive means comprises a motor (11); and
wherein the drive shaft (33) is supported in an adaptor sleeve in at least one bearing (43, 45) and coupled to the motor (11).

8. A burner according to claim 7, wherein the gasifier (17) and the at least one bearing (45) of the drive shaft (33) are spaced by a distance, which is equivalent to approximately the length of the gasifier (17).

9. A burner according to claim 6, wherein connecting means (57) are provided which rotatably connect the gasifier (17) to the drive shaft (33).

10. A burner according to claim 1, including a stationary electric heater (39) at least in part surrounding, with clearance, the rotatable gasifier (17).

11. A burner according to claim 10, wherein the recirculation means includes a flame tube (21) coaxially surrounding and spaced apart from the gasifier (17) and the electric heater (39).

12. A burner according to claim 1, wherein the recirculation means comprises a flame tube (21) surrounding the gasifier, and a recirculation inlet (79) to the gasifier (17).

13. A burner according to claim 1, including an air aperture plate (35) located between the drive means (11) and the gasifier (17), said air aperture plate (35) having an opening (77) for the supply of air to the inlet (53) of the gasifier (17).

14. A burner according to claim 13, wherein the air aperture plate (35) is spaced apart from the gasifier (17), the gap between the air aperture plate (35) and gasifier (17) forming a recirculation inlet (79) of the recirculation means.

15. A burner according to claim 1, including at least one mixing prong (81) protruding into the gasifier (17).

16. A burner according to claim 15, wherein a number of mixing prongs (81) are provided, located concentrically about the opening (77) of the air aperture plate (35).

17. A burner according to claim 1, including an apertured baffle plate (31), located spaced apart from the outlet (55) of the gasifier (17).

18. A burner according to claim 17, wherein the rotatable gasifier (17), the mixing head (29), a baffle plate (31) at the outlet of the gasifier (17), the drive shaft (33), an adaptor sleeve (37), an air aperture plate (35), an electric heater (39) and an ignition electrode (41) form a replacement component unit (27) for the burner.

19. A burner according to claim 1, further including a flame tube (21) surrounding, with clearance, said gasifier (17) and extending at least from said inlet (53) towards said outlet (55) and therebeyond, the spacing between the flame tube and the gasifier forming a recirculating path for hot combustion gases from the outlet (55) to the inlet (53);

and an ignition electrode (41') having an electrode tip (41) located in said recirculation path.

20. A burner according to claim 1, including a fuel volume control unit (25), for controlling the fuel supply.

21. A burner according to claim 1, further including an ignition electrode (41') having an electrode tip positioned in the vicinity of the outlet (55) for the gas/air mixture, said electrode tip (41) being set back from said outlet and positioned in the path of recirculation of the gases from the outlet to the inlet.

22. A burner according to claim 1, wherein the gasifier (17) has means (65) for increasing its effective surface area above the surface area thereof defined by a theoretical envelope of the gasifier.

23. A burner according to claim 22, wherein the means for increasing the surface area are formed by an insert (65) that at least partially covers the inner wall of the gasifier (17).

24. A burner according to claim 23, wherein the insert (65) has a flange (66) protruding essentially radially inward.

25. A burner according to claim 22, wherein the means (65) for increasing the surface area of the gasifier (17) includes a metal cloth, at least in part covering the inner wall of the gasifier (17).

26. A burner according to claim 22, including a nozzle aimed at an inner wall of the gasifier, located at the end of the fuel supply line (19') and extending close to the inner surface of said means (65) for increasing the surface area.

27. A burner according to claim 1, wherein the burner is arranged vertically.

28. A burner according to claim 27, wherein at least a portion (17') of the gasifier (17) is slightly conical, with the smaller diameter located at the bottom.

29. A burner according to claim 1, wherein the means for circulating the hot combustion gases from the outlet (55) to the inlet (53) comprises a stationary flame tube (21) surrounding, with clearance, said gasifier (17) and extending at least from said inlet (53) towards said outlet (55) and therebeyond, the spacing between the flame tube and the gasifier forming a recirculating path for hot combustion gases from the outlet (55) to the inlet (53); and an air aperture plate (35), located opposite the inlet (53) of the gasifier, said air aperture plate (35) having an opening (77) for supply of air to the inlet (53), said air aperture plate (35) being spaced from the gasifier (17) and defining a gap with respect to the gasifier, the gap between the air aperture plate (35) and the gasifier (17) forming a recirculation inlet (79) of the recirculating means.

30. A burner according to claim 29, wherein the air aperture plate (35) extends essentially diametrically across the flame tube (21) and separates the flame tube into a hot region surrounding said gasifier (17) and extending therebeyond, and a cool region extending towards said drive means (11).

31. A burner according to claim 29, wherein the opening (77) in the air aperture plate is essentially concentric with the axis of rotation of said rotating gasifier (17), and has a diameter which is smaller than the diameter of the gasifier;

and fan means (15) are provided for supplying combustion air through said opening into the interior of said gasifier.

32. A burner according to claim 1, including a mixing head (29), located at an outlet (55) of the gasifier (17).

33. A burner according to claim 32, wherein the mixing head (29) includes a fan wheel, located spaced apart from the outlet (55) of the gasifier (17) and having radial blades (30).

34. A burner according to claim 32, wherein the mixing head (29) includes a deflector part (31), the mixing head being located spaced apart from the outlet (55) of the gasifier (17), and having projecting means (30') facing the gasifier for intense mixing of fuel and air.

35. A burner according to claim 32, wherein a gas-air mixture deflector portion (31, 31') is provided, located downstream of the outlet (55) for the gas-air mixture on the gasifier (17) in the path of the gas-air mixture for deflecting the gas-air mixture from the outlet (55) towards the recirculating means (21), and wherein the gasifier (17), the mixing head (29, 429) and the deflector portion (31, 31') form a single component unit (18).

36. A burner according to claim 35, wherein the gasifier (17) and mixing head 429 comprises a single tube segment.

37. A burner according to claim 36, wherein blades (30) of the mixing head (29) are formed as stamped portions of the wall of the tube segment.

38. A burner according to claim 37, wherein the blades (30) protrude inwardly.

39. A burner comprising a rotating gasifier (17), said gasifier including a hollow body of rotation, rotating at high speed;

an inlet (53) for air and an outlet (55) for a gas/air mixture;

a drive means (11) coupled to the gasifier for rotating the gasifier (17);

means (13, 25, 19) for supplying fuel to the interior of the gasifier;

means (21, 79) for recirculating hot combustion gases from the outlet (55) to the inlet (53); and deflector means (31, 31') located axially spaced from the outlet (55) of the gasifier (17) for deflecting the gas/air mixture radially outwardly from the gasifier.

40. The burner of claim 39, wherein the recirculation means comprises a flame tube (21) surrounding the gasifier (17) and a recirculation inlet (79) adjacent the inlet (53) to the gasifier, said flame tube (21) extending axially beyond said deflector means (31, 31') to confine a flame produced adjacent the outlet (55) of the gasifier and ensure recirculation of a portion of hot combustion gases through said recirculation means.

41. The burner of claim 39, wherein the means for circulating the hot combustion gases from the outlet (55) to the inlet (53) comprises a stationary flame tube (21) surrounding, with clearance, said gasifier (17) and extending at least from said inlet (53) towards said outlet (55) and therebeyond, the spacing between the flame tube and the gasifier forming a recirculating path for hot combustion gases from the outlet (55) to the inlet (53); and an air aperture plate (35), located opposite the inlet (53) of the gasifier, said air aperture plate (35) having an opening (77) for supply of air to the inlet (53), said air aperture plate (35) being spaced from the gasifier (17) and defining a gap with respect to the gasifier, the gap between the air aperture plate (35) and the gasifier (17) forming a recirculation inlet (79) of the recirculating means.

42. The burner of claim 39, wherein the recirculation means comprises a flame tube (21) surrounding the gasifier (17) and a recirculation inlet (79) adjacent the inlet of the gasifier, said flame tube (21) extending in the vicinity of said deflector means (31, 31') to control a flame produced adjacent the outlet (55) of the gasifier (17) and ensure recirculation of a portion of hot combustion gases through said recirculation means.

* * * * *